US007988536B2

(12) United States Patent
Louh

(10) Patent No.: US 7,988,536 B2
(45) Date of Patent: Aug. 2, 2011

(54) GRINDING METHOD FOR GRINDING WORKPIECES

(75) Inventor: Sei-Ping Louh, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 381 days.

(21) Appl. No.: 12/178,819

(22) Filed: Jul. 24, 2008

(65) Prior Publication Data

US 2009/0163125 A1 Jun. 25, 2009

(30) Foreign Application Priority Data

Dec. 25, 2007 (CN) ..... 2007 1 0203399

(51) Int. Cl.
*B24B 9/00* (2006.01)

(52) U.S. Cl. ..... 451/43; 451/41

(58) Field of Classification Search ..... 451/41, 451/43, 28, 384, 385, 390, 398
See application file for complete search history.

(56) References Cited

U.S. PATENT DOCUMENTS 3,027,693 A * 4/1962 Armitage ..... 451/460
4,624,081 A * 11/1986 Janutta ..... 451/232
6,641,466 B2 * 11/2003 Wallendorf et al. ..... 451/285

FOREIGN PATENT DOCUMENTS

CN 1962189 A 5/2007
EP 0663264 A1 7/1995

* cited by examiner

*Primary Examiner* — Robert Rose
(74) *Attorney, Agent, or Firm* — Andrew C. Cheng

(57) ABSTRACT

An exemplary grinding method includes, firstly, providing a holding device including a first rotatable pressing portion and a second rotatable pressing portion, and providing a base. Then a number of workpieces are placed into a groove of the base. Two blocking members identical in shape are placed in the groove, with the workpieces therebetween. The blocking members are moved towards the workpieces to closely align with the workpieces. The sizes of the blocking members are compared with that of each workpiece, and then the blocking members are removed. If the workpieces are larger than the blocking members, the workpieces are thereafter held between the first and second pressing portions. Next, the base is removed and the first and second pressing portions are driven to rotate. Subsequently, the workpieces are ground, and then a number of finished products are obtained.

4 Claims, 5 Drawing Sheets

GRINDING METHOD FOR GRINDING WORKPIECES

BACKGROUND

1. Technical Field

The present invention relates to a grinding apparatus having a pressing portion for shaping a surface of a workpiece.

2. Description of Related Art

A roll grinder is generally utilized to round and/or polish a surface of a workpiece (see "High Efficiency Deep Grinding of a Low Alloy Steel with Plated CBN Wheels", CIRP Annals-Manufacturing Technology, pp. 241-244, Volume 51, Issue 1, 2002). A typical roll grinder includes a pair of hollows. In a grinding process, the hollows are pumped/evacuated so as to create suction to hold a workpiece. The workpiece is then grinded using a grinding wheel. However, this grinder is not very efficient because the grinder can only shape one workpiece at a time.

There are grinding methods for grinding a number of workpieces at one time. In one related grinding method, the workpieces are placed on a grinding bed, coated with a ultraviolet (UV) emulsion, and exposed to a UV light to cure the UV emulsion until the workpieces become attached to the grinding bed. The workpieces are grinded, and the UV emulsion is melted to displace/detach the workpieces from the grinding bed. However, drawbacks to this grinding method include contamination from retention of the UV emulsion on the workpieces and the steps of curing and melting the UV emulsion are time consuming and increase production costs.

Therefore, a grinding apparatus and a grinding method that avoids potential shortcomings associated with the UV emulsion and that is generally quicker and cheaper than the known mounting methods associated with roller grinders is desired.

SUMMARY

A grinding apparatus for grinding at least one workpiece includes a base, a first pressing portion and a second pressing portion. The base is configured for receiving the workpiece. The first pressing portion and a second pressing portion are configured for pressing against the workpiece cooperatively, so as to hold the workpiece between the first pressing portion and the second pressing portion. The first pressing portion and the second pressing portion are moveable and rotatable relative to the base for removing the workpiece from the base and rotating the workpiece clockwise and counter-clockwise.

Other advantages and novel features of the present grinding apparatus and grinding method will become more apparent from the following detailed description of preferred embodiments, when taken in conjunction with the accompanying drawings.

BRIEF DESCRIPTION OF THE DRAWINGS

Many aspects of the present apparatus and method can be better understood with reference to the following drawings. The components in the drawing are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE EMBODIMENTS

Embodiments of the present apparatus and method will now be described in detail below and with reference to the drawings.

Figure 1:
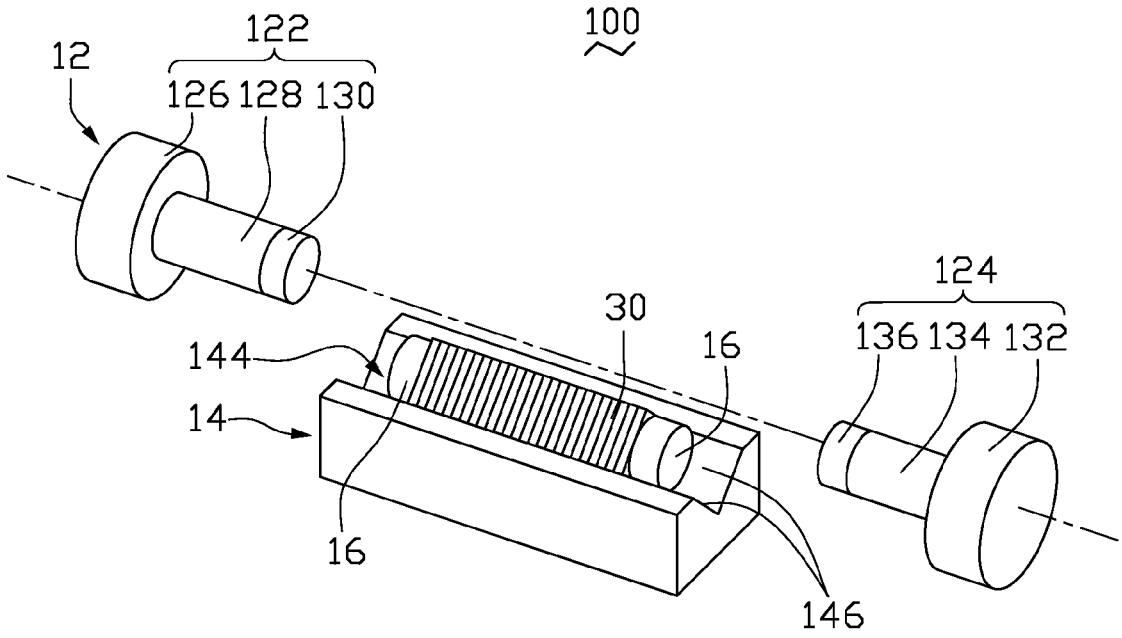
FIG. 1 is a schematic, isometric view of an embodiment of a grinding apparatus.

Referring to FIG. 1, a grinding apparatus 100 includes a holding device 12, a base 14 and two blocking members 16. The base 14 is configured for receiving the workpieces 30. In the illustrated embodiment, the grinding apparatus 100 is configured for grinding a plurality of workpieces 30 to a cylindrical shape or polish a surface of the workpiece 30.

The holding device 12 includes a first pressing portion 122 and a second pressing portion 124. The first pressing portion 122 includes a first driving member 126, a first rotation rod 128 and a first contact element 130. The holding device 12 is configured to hold the workpieces 30 between the first pressing portion 122 and the second pressing portion 124 by pressing against the workpieces 30.

The first driving member 126 is connected to a distal end of the first rotation rod 128. The first driving member 126 is configured for driving the first rotation rod 128 to rotate about a principal axis of the first rotation rod 128. The first contact element 130 is attached to a proximal end of the first rotation rod 128. The first contact element 130 is configured for contacting and holding the workpieces 30.

The second pressing portion 124 includes a second driving member 132, a second rotation rod 134 and a second contact element 136. The second driving member 132 is connected to a proximal end of the second rotation rod 134. The second driving member 132 is configured for driving the second rotation rod 134 to rotate about a principal axis of the second rotation rod 134. The second contact element 136 is attached to a distal end of the second rotation rod 134. The first rotation rod 128 is substantially coaxial to the second rotation rod 134. The second contact element 136 is configured for contacting and holding the workpieces 30. In one embodiment, the first contact element 130 and the second contact element 136 are made of a flexible material, such as rubber or flexible epoxy resin, to prevent scraping the workpieces 30.

The first contact element 130 is set facing towards the second contact element 136 for holding the workpieces 30. The first pressing portion 122 and the second pressing portion 124 can be moved towards or away from each other to allow holding the workpieces 30 with different thicknesses.

The base 14 includes a groove 144 configured for receiving the workpieces 30. The workpieces 30 to be grinded could be, for example, a plurality of square wafers, a plurality of square lenses, or other optoelectronic elements. Therefore, a shape of the groove 144 corresponds to a shape of the workpieces 30 or a shape that reduces the potential degrees of freedom of the workpiece. For example, the groove 144 may be V-shaped for holding the workpiece having at least one corner corresponding to that V-shape. In the illustrated embodiment, the groove 144 is defined by two inclined surfaces 146 forming an angle between the two inclined surfaces 146 that approximately equals 90 degrees. In this embodiment, the workpieces 30 to be grinded are all square shaped and have the same size. It may be appreciated that workpieces with different shapes can also be grinded by the grinding apparatus 100.

Two blocking members 16 are configured for blocking the workpieces 30 and squeezing the workpieces 30 to closely contact with one another in the groove 144. In one embodiment, the blocking member 16 is made of a high density material such as metal or an alloy. A material of the blocking member 16 can be selected from a group consisting of iron, copper, and stainless steel. In the illustrated embodiment, the blocking member 16 is cylindrical shaped. A radius of the blocking member 16 should be equal to a radius of the workpieces 30 after grinding. The blocking member 16 confirms whether the size of the workpieces 30 is large enough to form a cylindrical shape with a predetermined radius by comparing the surface of the blocking member 16 with that of the workpieces 30. For example, if the blocking member 16 is larger than the workpieces 30, then the workpieces 30 should not be grinded and replaced with workpieces 30 that are larger than the blocking member 16.

Figure 2:
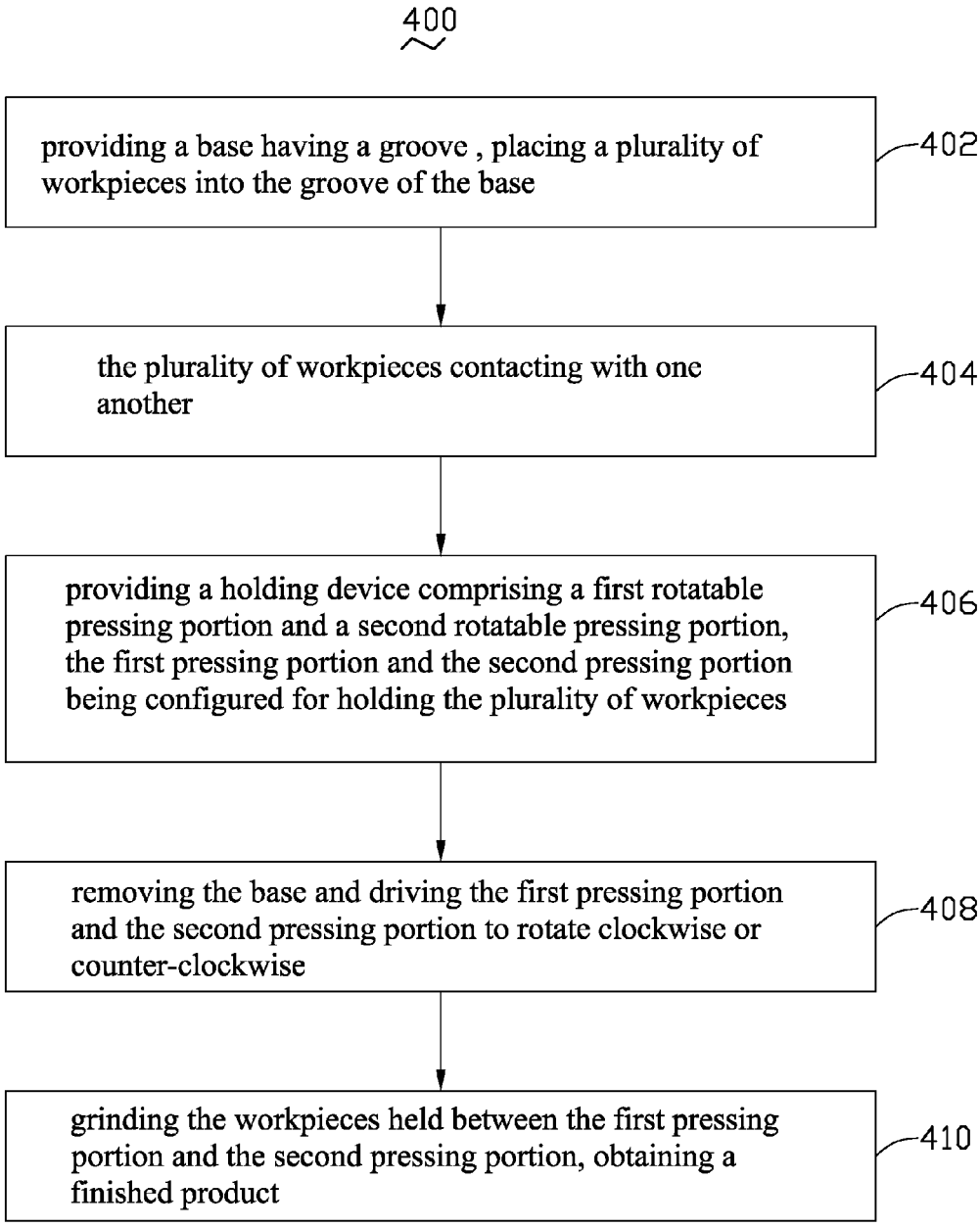
FIG. 2 is a flow chart of an embodiment of a grinding method using the grinding apparatus of FIG. 1.

FIG. 2 is a flowchart illustrating an embodiment of a grinding method 400 using the grinding apparatus 100. Depending on the embodiment, certain of the blocks described below may be removed, others may be added, and the sequence of blocks may be altered. The grinding method includes the following blocks:

Block 402: providing a base 14 having a groove 144, placing a plurality of workpieces 30 into the groove 144 of the base 14;

Block 404: the plurality of workpieces 30 contacting with one another;

Block 406: providing a holding device 12 comprising a first rotatable pressing portion 122 and a second rotatable pressing portion 124, the first pressing portion 122 and the second pressing portion 124 being configured for holding the plurality of workpieces 30;

Block 408: removing the base 14 and driving the first pressing portion 122 and the second pressing portion 124 to rotate clockwise or counter-clockwise;

Block 410: grinding the workpieces 30 held between the first pressing portion 122 and the second pressing portion 124, obtaining a finished product.

Figure 3:
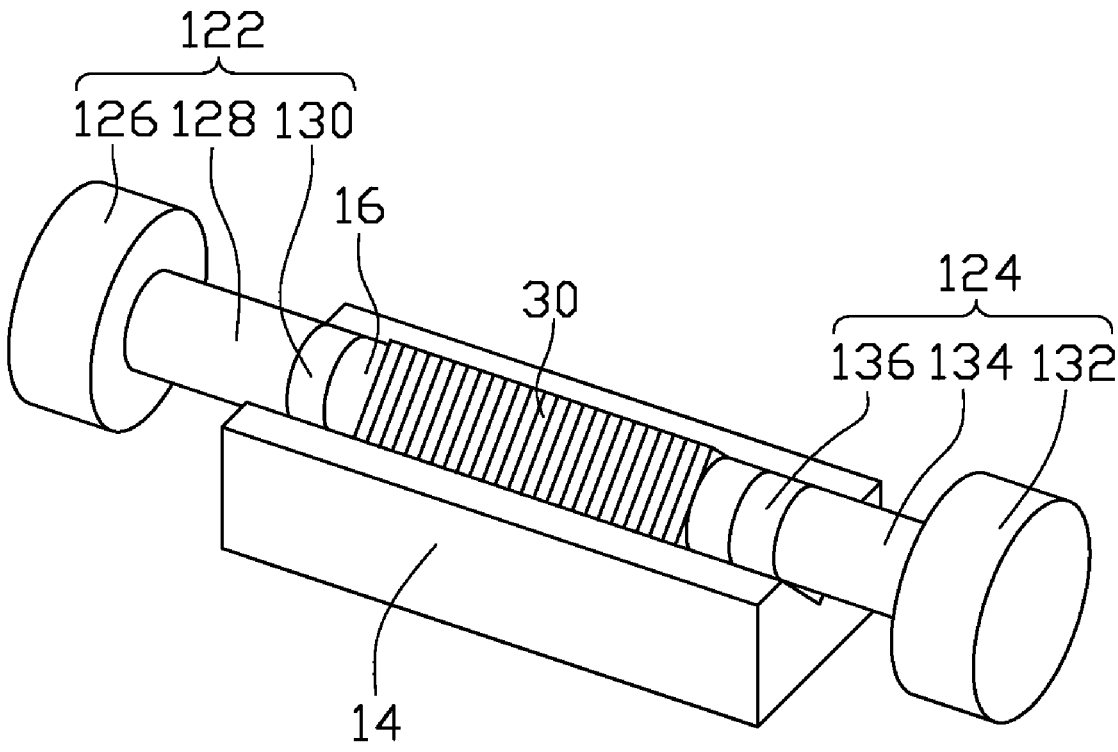
FIG. 3 is an isometric view of early stages of the process of the grinding method of FIG. 2 using the grinding apparatus of FIG. 1.

Referring to FIG. 3, in block 402, the plurality of workpieces 30 is placed in the groove 144 of the base 14. The workpieces 30 are in contact with the two inclined surfaces 146. In block 404, the two blocking elements 16 are received in the groove 144 and the workpieces 30 are sandwiched between the two blocking elements 16. The two blocking elements 16 are moved toward the workpieces 30 to make the workpieces 30 closely contact with one another.

Figure 4:
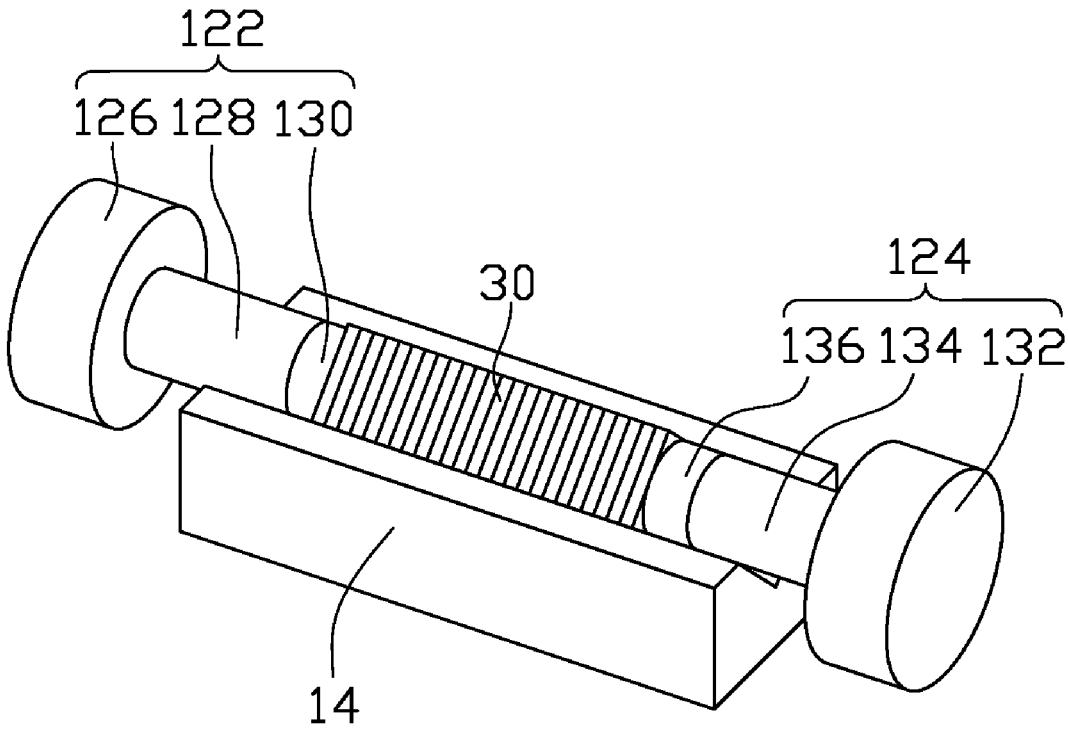
FIG. 4 is an isometric view of middle stages of the process of the grinding method of FIG. 2 using the grinding apparatus of FIG. 1.

Referring to FIG. 4, in block 406, the first pressing portion 122 and the second pressing portion 124 sandwich the two blocking members 16. The first rotation rod 128 and the second rotation rod 134 should both be coaxial to the workpieces 30. Then, the two blocking members 16 are removed and the first pressing portion 122 and the second pressing portion 124 are moved towards the workpieces 30 to sandwich the workpieces 30 together. The first contact element 130 and the second contact element 136 each contacts one of the plurality of workpieces 30. The compression force applied to the workpieces 30 by the first pressing portion 122 and the second pressing portion 124 should be strong enough to hold the workpieces 30 between the first contact element 130 and the second contact element 136.

Figure 5:
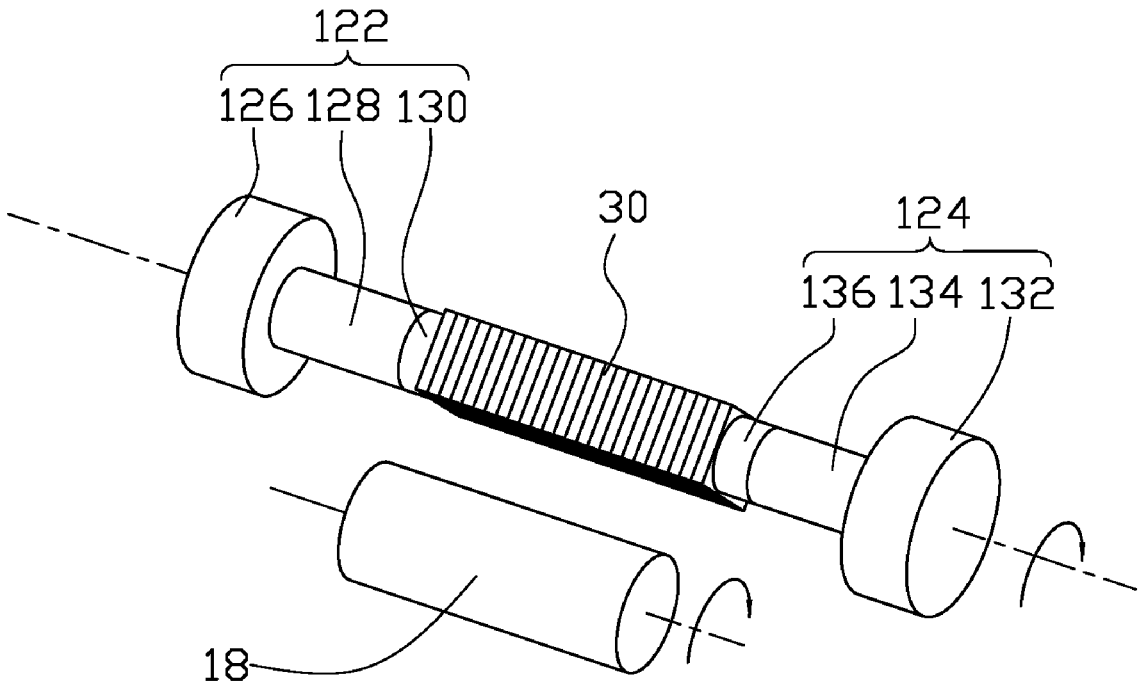
FIG. 5 is an isometric view of latter stages of the process of the grinding method of FIG. 2 using the grinding apparatus of FIG. 1.

Referring to FIG. 5, in block 408 and 410, the base 14 is removed. A grinding wheel 18 is provided to grind the workpieces 30. The grinding wheel 18 is driven by a motor (not shown) and to grind the workpieces 30. A principal axis of the grinding wheel 18 is parallel with that of the workpieces 30 while the grinding wheel 18 is grinding the workpieces 30.

While the grinding wheel 18 rotates to grinding the workpieces 30, the workpieces 30 are driven to rotate about a principal axis of the first rotation rod 128 and the second rotation rod 134. The first and second rotation rods 128 and 134 are rotated by the first and second driving members 126 and 132, respectively. A rotation speed and a rotation direction of the first rotation rod 128 must be equal to a rotation speed and a rotation direction of the second rotation rod 134. After the grinding process is completed, a plurality of finished products (not shown) is obtained. In the illustrated embodiment, the finished products are rounded products such as rounded lenses.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A grinding method comprising:

providing a holding device comprising a first rotatable pressing portion and a second rotatable pressing portion;

providing a base having a groove and placing a plurality of workpieces into the groove;

placing two blocking members in the groove with the plurality of workpieces between the two blocking members, wherein the two blocking members are identical in shape with a finished product;

moving the two blocking members towards the workpieces to make the workpieces closely contact each other and be coaxial with each other;

comparing the surfaces of the two blocking members with a surface of each of the plurality of workpieces so as to determine whether a size of each of the workpieces is large enough for forming a plurality of the finished products;

removing the two blocking members;

holding the plurality of workpieces between the first pressing portion and the second pressing portion after removing the two blocking members, when the size of each of the workpieces is large enough for forming the plurality of finished products;

removing the base and driving the first pressing portion and the second pressing portion to rotate clockwise or counter-clockwise, after holding the plurality of workpieces; and grinding the plurality of workpieces held between the first pressing portion and the second pressing portion, and then obtaining the plurality of finished products.

2. The grinding method of claim 1, wherein the groove has a shape that reduces the potential degrees of freedom of the plurality of workpieces.

3. The grinding method of claim 2, wherein the groove has a shape corresponding to a shape of a portion of the plurality of workpieces.

4. The grinding method of claim 1, wherein the step of grinding the plurality of workpieces comprises providing a grinding wheel with a principal axis parallel to a principal axis of the workpieces, moving the grinding wheel to a predetermined position, and driving the grinding wheel to rotate around the principal axis of the grinding wheel.

* * * * *